US008810345B1

(12) United States Patent
Goserud

(10) Patent No.: US 8,810,345 B1
(45) Date of Patent: Aug. 19, 2014

(54) DEVICE FOR RETRIEVING AND SECURING GOLF BALL MARKS

(71) Applicant: J. Thomas Goserud, Landisville, PA (US)

(72) Inventor: J. Thomas Goserud, Landisville, PA (US)

( * ) Notice: Subject to any disclaimer, the term of this patent is extended or adjusted under 35 U.S.C. 154(b) by 0 days.

(21) Appl. No.: 13/987,704

(22) Filed: Aug. 23, 2013

(51) Int. Cl.
*H01F 1/00* (2006.01)
*H01F 7/00* (2006.01)
*A63B 57/00* (2006.01)

(52) U.S. Cl.
CPC ..... *A63B 57/0075* (2013.01)
USPC ..... 335/219; 335/296

(58) Field of Classification Search
USPC ..... 335/219
See application file for complete search history.

(56) References Cited

U.S. PATENT DOCUMENTS

| | | | | | |
|---|---|---|---|---|---|
| 3,254,440 | A | * | 6/1966 | Duggar | 446/92 |
| 3,354,329 | A | * | 11/1967 | Reich | 310/36 |
| 3,781,736 | A | * | 12/1973 | Parker | 335/304 |
| 4,687,608 | A | * | 8/1987 | Eino | 427/130 |
| 5,109,172 | A | * | 4/1992 | Pace | 310/154.43 |
| 5,276,419 | A | * | 1/1994 | Griffin et al. | 335/216 |
| 5,641,064 | A | * | 6/1997 | Goserud | 206/315.1 |
| 5,716,520 | A | * | 2/1998 | Mason | 210/222 |
| 5,813,529 | A | * | 9/1998 | Goserud | 206/315.1 |
| D401,149 | S | * | 11/1998 | Goserud | D9/439 |
| D402,888 | S | * | 12/1998 | Goserud | D9/439 |
| D409,486 | S | * | 5/1999 | Goserud | D9/439 |
| 6,084,494 | A | * | 7/2000 | Chew et al. | 335/283 |
| 6,244,464 | B1 | * | 6/2001 | Goserud | 221/155 |
| D447,052 | S | * | 8/2001 | Goserud | D99/34 |
| D466,041 | S | * | 11/2002 | Goserud | D11/79 |
| 7,507,136 | B2 | * | 3/2009 | Patton | 446/92 |
| 7,757,376 | B2 | * | 7/2010 | Saitou et al. | 29/596 |

* cited by examiner

*Primary Examiner* — Shawki S Ismail
*Assistant Examiner* — Lisa Homza
(74) *Attorney, Agent, or Firm* — Norman B. Rainer

(57) ABSTRACT

A device for retrieving and securing golf ball marks while providing several modes of motion of the secured ball mark employs paired magnets oppositely positioned within a securing surface having circular curvature.

8 Claims, 2 Drawing Sheets

DEVICE FOR RETRIEVING AND SECURING GOLF BALL MARKS

RELATED APPLICATIONS

This application is based upon Provisional Patent Application Ser. No. 61/849,422 filed Jan. 29, 2013, hereby incorporated herein by reference, and whose filing date is claimed as the filing date of the present Utility Patent Application.

BACKGROUND OF THE INVENTION

1. Field of the Invention

This invention relates to the game of golf, and more particularly concerns a device for retrieving and viewing circular coin-shaped devices typically employed for marking the location of a golf ball.

2. Description of the Prior Art

Devices for marking the location of a golf ball, generally referred to as "ball marks" are frequently emplaced and retrieved within a single game of golf. The ball marks are generally rigid circular discs bounded by opposed substantially flat surfaces, and having a diameter of about 25 mm and thickness of about 1.5 mm. They are generally fabricated of ferromagnetic material such as iron, and contain a protective coating which may include embossing, as in coinage. One or both surfaces generally contain decorative or informational indicia.

In order to minimize the annoyance of having to frequently deploy and retrieve a ball mark during a game, magnetic techniques have been disclosed whereby the ball mark can be attached to and released from a golf bag or article of clothing such as a cap. This requires the two-fold sequence of retrieving the ball mark by hand from the turf, and then storing it upon a securing substrate.

Most golfers still prefer to put the ball mark in their pant's pocket, and the pocket is often cluttered with other paraphernalia. The retrieval of the ball mark from a pant's pocket is often challenging because of the small size of the ball mark and the sometimes tight-fitting pants usually preferred by women golfers.

A "fidgeting" hand manipulation has been known to sometimes relieve stress. This effect was made famous by the actor Humphrey Bogart in the classic film "The Caine Mutiny", where Bogart manipulated three steel balls in one hand. So, a ball mark securing device which permits a specialized or challenging movement via finger manipulation whether in or out of a golfer's pocket, could have special appeal to certain golfers.

The aforesaid indicia on the surfaces of the ball mark are generally intended to advertise products, organizations or institutions. Such feature of ball marks also cause them to be collectible items, especially when they may represent a significant golf tournament. Prior ball mark securing devices, especially those which cause the ball mark to magnetically attach to a substantially flat surface, prevent visual observation of both surfaces.

It is accordingly an object of the present invention to provide a ball mark retrieval device specially suited for accommodation within a golfer's pants pocket.

It is a further object of this invention to provide a ball mark retrieval device of the aforesaid nature which can secure a ball mark in a manner to enable both surfaces of the ball mark to be seen.

It is another object of the present invention to provide a ball mark retrieval device of the aforesaid nature which, when confined within a golfer's pants pocket, will automatically attract and secure a ball mark entered into said pocket.

It is a still further object of this invention to provide a ball mark retrieval device of the aforesaid nature which enables a ball mark retained thereby to be manipulated in a challenging manner by the golfer's hand.

These objects and other objects and advantages of the invention will be apparent from the following description.

SUMMARY OF THE INVENTION

The above and other beneficial objects and advantages are accomplished in accordance with the present invention by a device for attracting and holding a circular ferromagnetic golf ball marker, said device comprising a pair of diametrically positioned permanent magnets held adjacent a securing surface having circular curvature, said securing surface being located as an aperture within a substantially rigid frame having a center axis and plane of symmetry orthogonal to said axis. In preferred embodiments, the frame is fabricated of plastic as a doughnut-shaped structure.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 3:
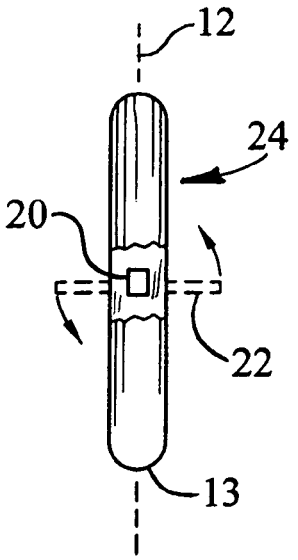
FIG. 3 is a top view of the device of FIG. 1 showing in broken outline a second mode of rotational motion of a secured ball mark.
Figure 4:
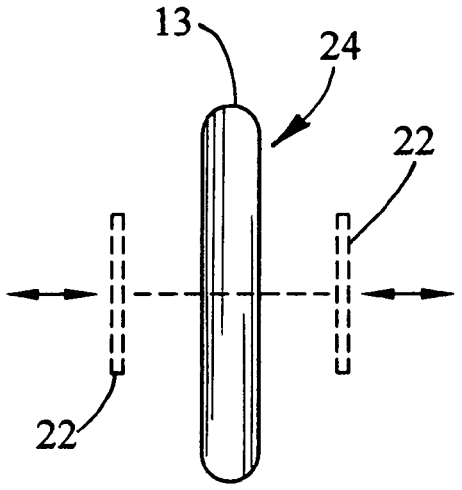
FIG. 4 is a view of the device of FIG. 1 showing a linear translational movement of a ball mark with respect to the device.
Figure 5:
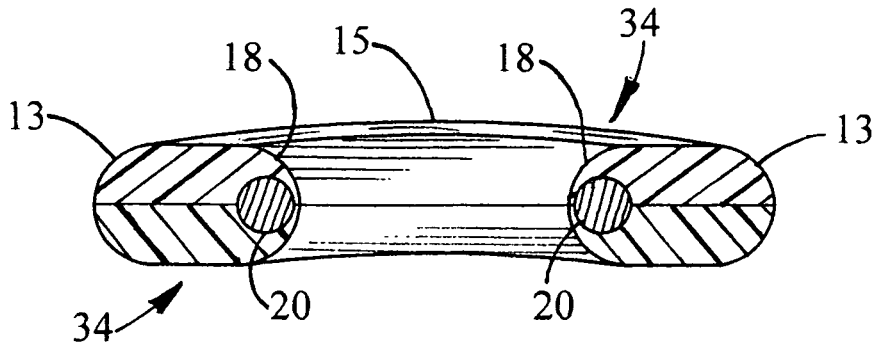
FIG. 5 is a perspective sectional view, taken in the direction of the arrows upon line 5-5 of FIG. 2.
Figure 6:
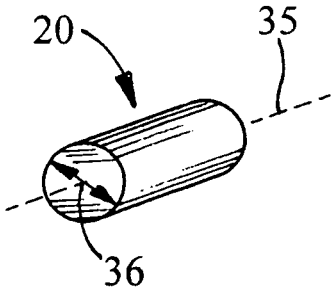
FIG. 6 is a perspective front and side view of a magnet of cylindrical configuration suitable for use in the device of the present invention.
Figure 7:
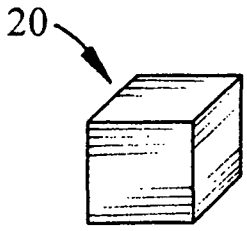
FIG. 7 is a perspective front and side view of a magnet of cubic configuration suitable for use in the device of this invention.

Referring now to FIGS. 1-5, an embodiment of the ball mark retrieving device 24 of this invention is shown comprised of a substantially rigid frame 10 of doughnut configuration having a vertical plane of symmetry 11 and horizontal plane of symmetry 12, a circular outer perimeter edge 13, and a circular aperture 14 having a securing surface 18 centered within perimeter 13 and defining a center axis 17. Frame 10 is bounded in part by exterior parallel surfaces 15 and 16 which define perimeter edge 13 and securing surface 18. Said securing surface is preferably rounded convexly with respect to axis 17. Such configuration, having a donut shape, is preferably fabricated of a hard or semi-rigid plastic, and may be a monolithic structure or a composite of two shaped halves 34 bonded together as shown in FIG. 5. The thickness of the frame, measured orthogonally between said exterior surfaces, is preferably between 5 and 8 millimeters. The diameter of circular aperture 14 is between 22 and 27 millimeters, and the diameter of circular outer perimeter edge 13 is between 45 and 55 millimeters.

A pair of preferably identical permanent magnets 20 are embedded within frame 10 at locations which are diametrically opposed about axis 17. Said magnets are of rare earth composition, wherein at least one magnet has a pull force of 1 to 4 pounds and a surface field of 6300 to 6800 gauss. The magnets may have a circular cylindrical rod-like configuration as exemplified in FIGS. 1-6, having a diameter 36 in the range of about ⅛" to 3/16", and a length in the range of about ¼" to ⅜", causing the ratio of length to diameter to be preferably between 2/1 and 3/1. Magnets of other shapes, such as cubic and disc-shaped may also be employed having the aforesaid strength characteristics and maximum dimensions smaller than ¼".

When cylindrical magnets are employed, they are emplaced such that their length axes 35 are in parallel relationship and equally spaced from axis 17 within horizontal plane of symmetry 12. Suitable magnets are available from the K and J Magnetics Corporation of Jamison, Pa. The paired magnets, in concert, are preferably capable of lifting a ferromagnetic ball mark 22 a distance of 7 to 12 millimeters. Ball marks which are retrievable by the device of this invention have a circular diameter of about 25 millimeters and a weight between about 2 and 6 grams.

Figure 2:
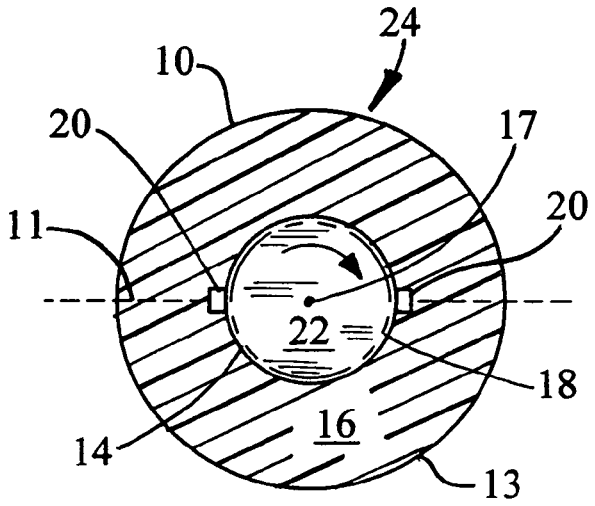
FIG. 2 is a sectional view taken in the direction of the arrows upon line 2-2 of FIG. 1, and showing in broken outline a ball mark, not a part of this invention, secured within the retrieving device and provided with a rotational first mode of movement, as indicated by the arrowed line.
Figure 1:
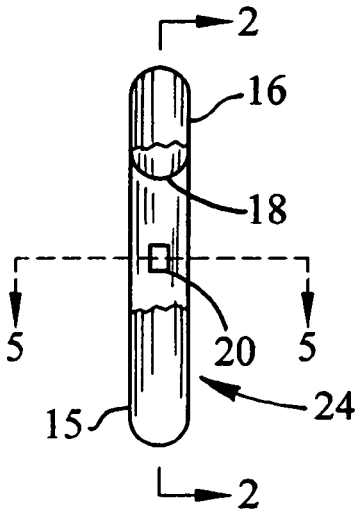
FIG. 1 is a side view of an embodiment of the retrieving device of the present invention with portions broken away.

In operation, a ball mark engaged by securing surface 18 can be manipulated in three different ways. In a first mode of movement, as indicated in FIG. 1, the ball mark can revolve about axis 17 within the horizontal plane of symmetry 12. In a second mode of movement, as indicated in FIG. 3, the ball mark may be rotated about an axis extending between paired magnets 20, whereby the path of rotation is orthogonal to frame 10. In a third mode of movement, as indicated in FIG. 4, ball mark 22 can be pulled outwardly away from engagement with the device 24, then released, whereupon it will be pulled back into engagement with securing surface 18.

It has been found that, when having critically selected dimensions, the doughnut configuration of frame 10 provides the further advantage of enabling the golfer to find and remove the device from the pocket of tight-fitting trousers merely by inserting a finger into aperture 14. When thusly engaged, the device is less likely to be dropped, and can be rotated about the finger for gratification to relieve nervous tension. Such further advantages are achievable particularly when the thickness of frame 10 is between 5 and 8 millimeters, said securing surface is rounded, and the ratio of the diameter of aperture 14 to the diameter of perimeter 13 is between 0.45 and 0.55.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for attracting and securing a circular ferromagnetic golf ball mark, said device comprising a pair of diametrically positioned permanent magnets held adjacent a circular securing surface located as an aperture within a substantially rigid frame fabricated of plastic as a doughnut-shaped structure having a circular outer perimeter and a vertical center axis and horizontal plane of symmetry, said secured golf ball mark being moveable in at least three different modes of movement while permitting visual observation of both surfaces of said ball mark.

2. The device of claim 1 wherein said magnets are of identical configuration.

3. The device of claim 1 having a vertical plane of symmetry that orthogonally bisects said frame.

4. The device of claim 1 wherein said magnets have a cylindrical configuration characterized by an axial length and uniform circular cross-section.

5. The device of claim 4 wherein the ratio of said axial length to the diameter of said cross-section (L/D) is between 2 and 3.

6. The device of claim 5 wherein said magnets are positioned within said frame adjacent said securing surface in diametrically opposed locations and with said axial lengths being in parallel relationship and lying within said horizontal plane of symmetry.

7. The device of claim 1 wherein at least one magnet has a pull force of 1 to 4 pounds, thereby enabling the device to be capable of lifting a substantially flat ferromagnetic ball mark of 2 to 6 gram weight a distance of 7 to 12 millimeters.

8. The device of claim 1 wherein the thickness of said frame is between 5 and 8 millimeters, and the ratio of the diameter of said securing surface to the diameter of said outer perimeter is between 0.45 and 0.55.

* * * * *